US006045101A

United States Patent [19]

Goyette et al.

[11] Patent Number: 6,045,101

[45] Date of Patent: Apr. 4, 2000

[54] ARTICLE SUPPORT

[75] Inventors: Paul D. Goyette, Penetanguishine; Patrick R. Maheu, Midland, both of Canada

[73] Assignee: Waltec Plastics Inc., Ontario, Canada

[21] Appl. No.: 09/016,486

[22] Filed: Jan. 30, 1998

[51] Int. Cl.[7] ..... A47G 29/02

[52] U.S. Cl. ..... 248/235; 312/408

[58] Field of Search ..... 248/346.01, 235, 248/247, 250, 346.5; 312/404, 408; 108/27

[56] References Cited

U.S. PATENT DOCUMENTS

| | | | |
|---|---|---|---|
| 3,102,499 | 9/1963 | Shelor | 108/28 |
| 3,633,983 | 1/1972 | Whitcomb | 312/270 |
| 4,923,260 | 5/1990 | Poulsen | 312/408 |
| 4,960,308 | 10/1990 | Donaghy | 312/404 |
| 5,300,748 | 4/1994 | Colombo | 219/734 |
| 5,441,338 | 8/1995 | Kane et al. | 312/408 |
| 5,660,777 | 8/1997 | Herrmann et al. | 264/154 |

*Primary Examiner*—Anita M. King
*Attorney, Agent, or Firm*—Morrison & Foerster LLP

[57] ABSTRACT

An article support such as a shelf or a table top has a frame that, in its heated state, slidably receives a glass or plastic planar sheet into grooves along two opposing edges of the frame, until an end of the sheet abuts a third edge of the frame that joins the two opposing edges. The edges of the frame have lips that rest on a portion of the top surface of the sheet. When cooled, the frame contracts such that the edges of the sheet are tightly engaged within the grooves of the frame and the lips tightly abut the top surface of the sheet, thereby creating an article support that resists spills around its periphery. The frame may be reheated to expand the material of the frame, permitting removal of the sheet from the frame. Thus, the frame and the sheet may be recycled.

22 Claims, 7 Drawing Sheets

ARTICLE SUPPORT

FIELD OF THE INVENTION

The present invention relates to article supports, such as shelves and table tops, and more particularly, to an article support that is generally spill-resistant and to a method for producing such an article support.

BACKGROUND OF THE INVENTION

Article supports include shelves and table tops which may be used to support a variety of items. Conventionally, cabinets and appliances, such as hospital cabinets, kitchen cabinets and refrigerators, have multiple shelves for storing items, including liquids such as medicines, food, and beverages, vertically upright. Typically, such shelves extend between two interior upstanding appliance or cabinet walls, and are generally level. Tables, such as kitchen tables, have a table top which is a horizontal surface that can support a variety of items, including liquids such as food and beverages. Typically, such table tops are supported by three or more vertical legs to maintain them in a horizontal position, a suitable distance from the floor.

Article supports may be made of a tempered glass sheet surrounded by a plastic or metal frame. Items are placed on the top surface of the sheet portion of such article supports. When liquid spills on one of the article supports, it may not be confined to that article support and may overflow from the article support at its edges. The frame surrounding the sheet is often designed to limit this overflow, so that small spills can be trapped at the frame. However, even with small spills, liquid often leaks through the junctures between the sheet and the frame and spills to the shelf or floor below it. It is therefore desirable to prevent leaking of liquid from the top surface of such shelves at the juncture between the sheet and the frame, providing a shelf with improved spill resistance.

Framed article supports are typically manufactured either by pre-manufacturing a frame and dropping the glass in the frame (the "drop in glass method") or by moulding a frame directly about a glass sheet (the "encapsulation method").

In the "drop in glass method", the front, rear and side portions of a metal or plastic frame are first individually extruded from metal or plastic. These frame portions are then attached to form a frame, and a tempered glass sheet is slid freely into the frame to create the article support. As there is no chemical or mechanical bond between the top surface of the sheet and the frame, article supports made by this method are not very spill-resistant. Also, such frames lack integrity and often come apart, as the frame portions are attached together.

In the "encapsulation method", a tempered glass sheet is secured in a plastic injection mould. A hot melt of resin is then moulded around the edge of the glass and is permitted to cool to create the framed article support. As will be appreciated, the resin forms a tight bond with the glass sheet near its edges, by adhering to the glass. Although this may produce an article support that has increased spill-resistance, it does not permit easy removal of the glass from the frame to permit recycling of the frame and the glass, should the sheet or frame break. Moreover, this method requires an injection mould particularly suited to seat a glass sheet. Additionally, this method results in significant glass breakage, of up to approximately 30%, during the manufacturing process. As will be understood, this waste increases the overall production costs of such article supports, causes an occupational hazard, and raises environmental concerns.

Finally, as the glass sheet is superheated at its perimeter and placed under extreme pressure during the injection moulding process, the resulting article support may be weak and prone to break, in use.

The present invention attempts to overcome some of the disadvantages associated with known article supports, and methods for producing such article supports.

SUMMARY OF THE INVENTION

It is an object of the present invention to provide an improved spill-resistant article support and method for producing such an article support.

In accordance with one aspect of the present invention there is provided a spill-resistant article support comprising a generally planar sheet having a flat top surface; a frame receiving said sheet, said frame comprising: first and second opposing side members each defining a lengthwise extending groove; said grooves receiving opposing edges of said planar sheet; said first and second side members each comprising a side lip; each said side lip covering a portion of said top surface; a front member, extending between said side members and in abutment with an end of said sheet; said front member comprising a front lip; said front lip covering a portion of said top surface; said side lips meeting said front lip such that said lips extend continuously along a periphery of said sheet; said frame comprised of heat sensitive material; said material adapted to expand at a first temperature so that said sheet is freely slidable within said grooves for easy removal of said sheet from said frame; said material further adapted to contract at a second temperature so that said edges of said sheet are tightly engaged within said grooves and said side and front lips tightly abut said top surface to inhibit spillage of liquids from said top surface at said periphery.

In accordance with another aspect of the present invention there is provided a method for producing a spill-resistant article support comprising the steps of: a. moulding a frame using heated plastic, said frame comprising first and second opposing side members each defining a lengthwise extending groove; said first and second members each comprising a side lip; said frame further comprising a front member, extending between said side members; said front member comprising a front lip; said side lips meeting said front lip such that said lips extend continuously along a perimeter of said frame; b. allowing said frame to partially cool and sufficiently harden to withstand insertion into said grooves of a planar sheet having a thickness less than that of said grooves; c. sliding said generally planar sheet into said grooves until an end of said sheet abuts said front member such that said frame receives edges of said planar sheet and said side and front lips cover a portion of said top surface; d. cooling said frame and said sheet, thereby permitting said frame to contract so that said edges of said sheet are tightly engaged within said grooves and said side and front lips tightly abut said top surface of said planar sheet.

In accordance with yet another aspect of the present invention there is provided a method of disassembling an article support, said article support comprising: a generally planar sheet; a frame receiving said sheet; said frame comprising first and second opposing members each defining a lengthwise extending groove; said grooves receiving opposing edges of said planar sheet; said edges of said sheet tightly engaged within said grooves of said frame; said frame made of a heat sensitive material and having a slot, comprising the steps of: a. heating said article support, so that said heat sensitive material expands so that said sheet is freely slidable within said grooves of said frame; b. removing said sheet from said frame through said slot.

The present invention provides a spill-resistant article support and a method for producing such an article support. As the method does not require superheating of the sheet and subjecting the sheet to high pressure, glass breakage may be minimized. The resulting article support maintains its integrity in the finished product. Also, should either the frame or sheet portion of the article support break, recycling of either element is permitted, as the sheet may be easily removed by warming the frame.

BRIEF DESCRIPTION OF THE DRAWING

In figures which illustrate preferred embodiments of the invention.

DETAILED DESCRIPTION OF THE PREFERRED EMBODIMENTS

Figure 1:
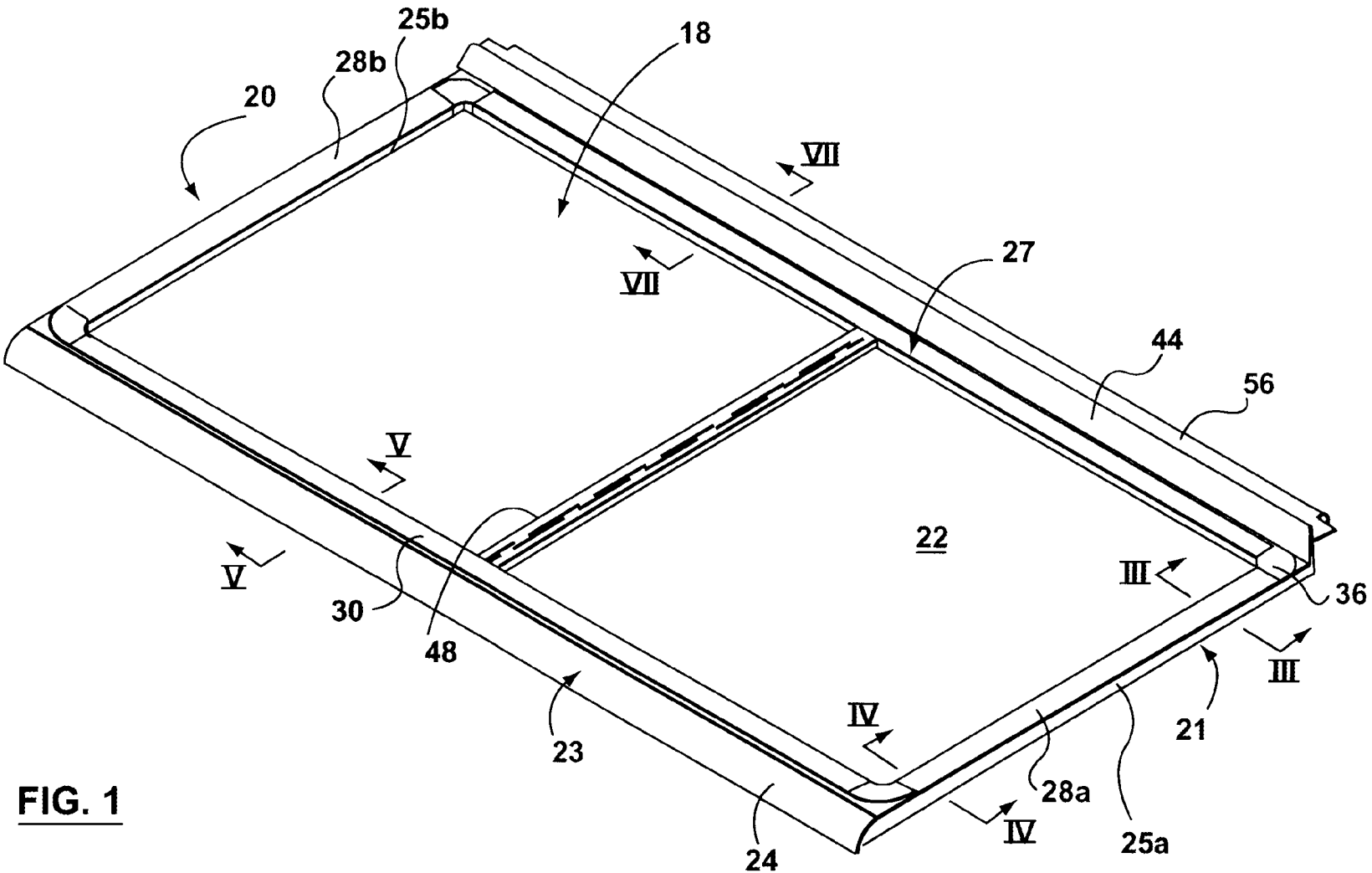
FIG. 1 is a perspective view of a shelf from above.
Figure 2:
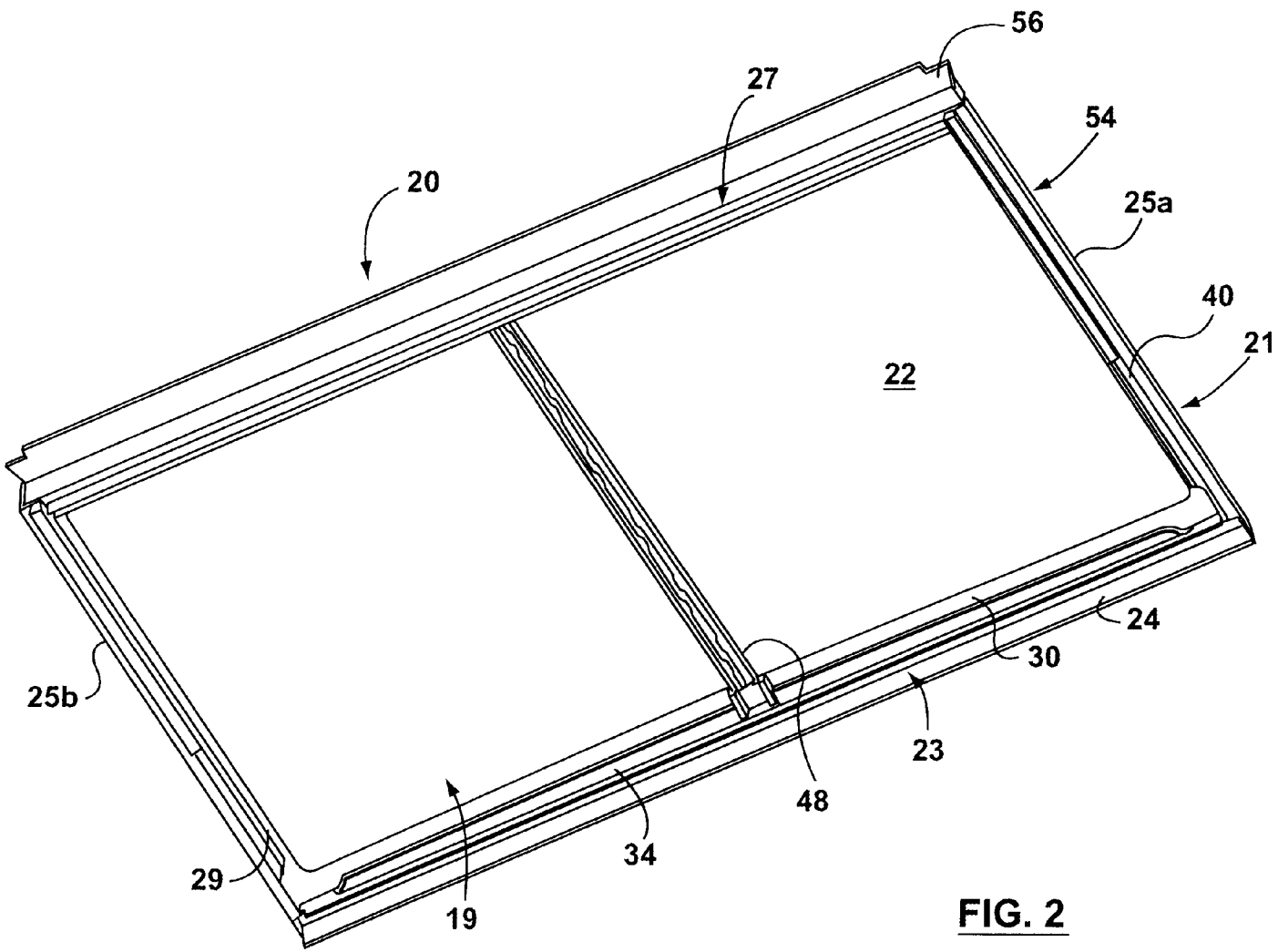
FIG. 2 is a further perspective view of the shelf of FIG. 1, from below.

FIGS. 1 and 2 illustrate a shelf 20 exemplary of an article support in accordance with the invention. Shelf 20 comprises a rectangular sheet 22, enclosed around its periphery by a frame 21. Sheet 22 is planar, made of tempered glass, and has a generally flat top surface 18 and a generally flat bottom surface 19.

Frame 21 comprises a front frame member 23, side frame members 25*a*, 25*b*, and a rear frame member 27. Front frame member 23 and rear frame member 27 are of equal length. The side members 25*a* and 25*b* are also of equal length, and extend at right angles from the ends of front and rear frame members 23 and 27. The front member 23 and rear member 27 are longer than the side members 25*a* and 25*b*, making frame 21 generally rectangular in shape, complementary to sheet 22.

Figure 3:
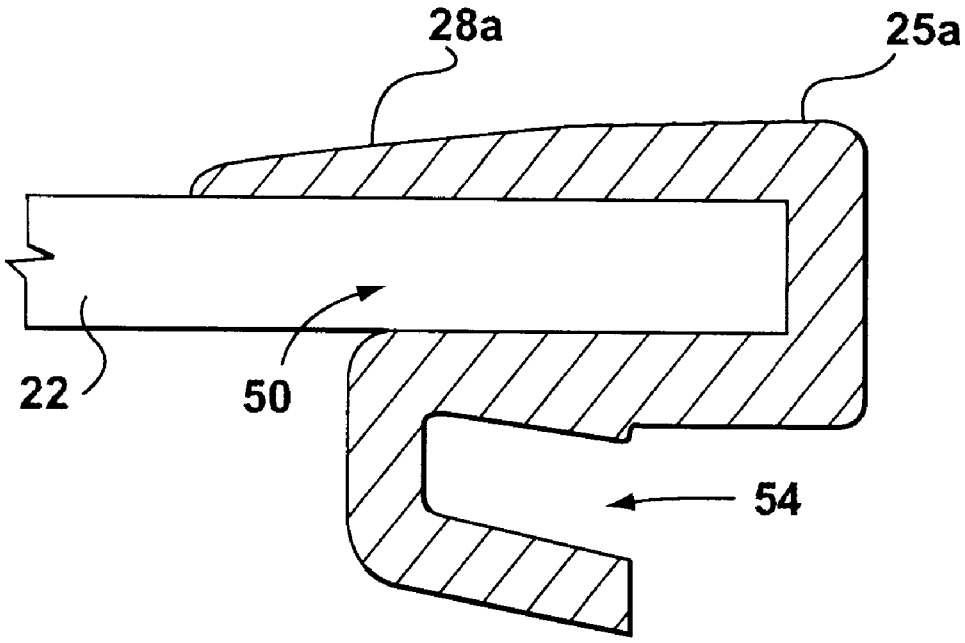
FIG. 3 is a cross-sectional view taken along line III—III of FIG. 1.

Side frame member 25*a* has a generally backward S-shaped cross-section, proximate rear frame member 27, as best illustrated in FIG. 3. The upper leg of the backward S-shaped cross-section terminates in a lip 28*a*. The top half of the backward S-shaped outline defines a groove 50 in side frame member 25*a* which receives a side edge of sheet 22. The bottom portion of the generally backward S-shaped outline defines a mounting channel 54. Thus channel 54 is directly below groove 50. As described below, channel 54 permits mounting of shelf 20 within a cabinet or appliance.

Figure 4:
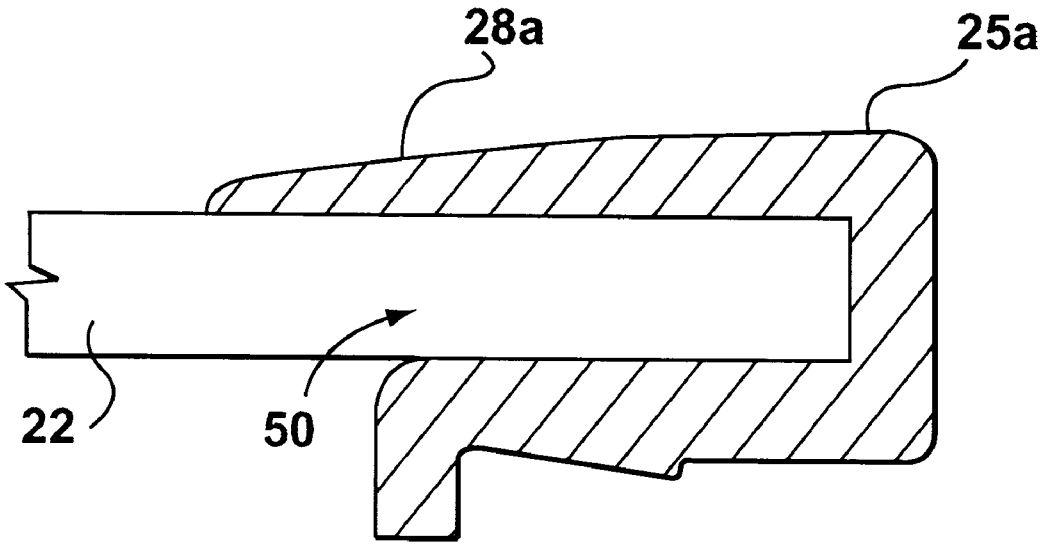
FIG. 4 is a cross-sectional view taken along IV—IV of FIG. 1.

As illustrated in FIG. 2, channel 54 only extends partway from rear frame member 27 toward front frame member 23, along side member 25*a*. Thus, in cross-section, side member 25*a* is generally C-shaped proximate front member 23, as illustrated in FIG. 4. As seen in FIGS. 1, 3 and 4, lip 28*a* extends continuously along side frame member 25*a* from rear frame member 27 to front frame member 23. Side frame member 25*b* is a mirror image of side frame member 25*a*.

Figure 5:
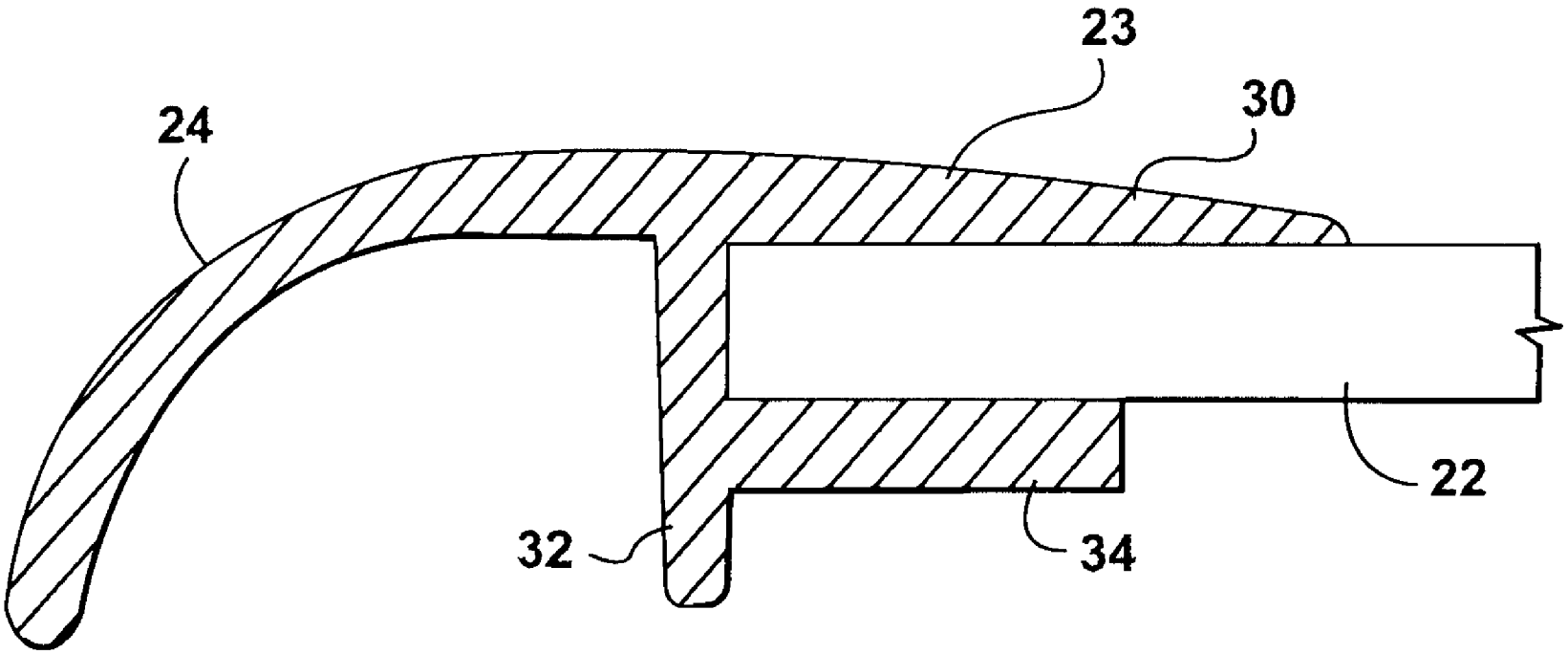
FIG. 5 is a cross-sectional view taken along V—V of FIG. 1.

The cross-section of front frame member 23 along the majority of its length is illustrated in FIG. 5. As shown, the outer frontmost portion 24 of front frame member 23 is bevelled and downwardly sloped the entire length of front frame member 23 (see FIG. 1), such that the front portion 24 of front member 23 has a smooth, rather than a sharp, edge to prevent injury when placing items onto or removing items from shelf 20. A lip 30 extends rearwardly from front portion 24. An abutting wall 32 extends vertically downward at the intersection of lip 30 and front portion 24 of front frame member 23, to abut a front edge of sheet 22 at a right angle. A bottom ledge 34, extends from wall 32 below, and in a direction parallel to, lip 30 so that sheet 22 is received between lip 30 and ledge 34 and is in abutment with wall 32 such that sheet 22 is supported at its front edge by ledge 34. As illustrated in FIG. 2, ledge 34 is discontinuous near the mid-point of front frame member 23.

Figure 8:
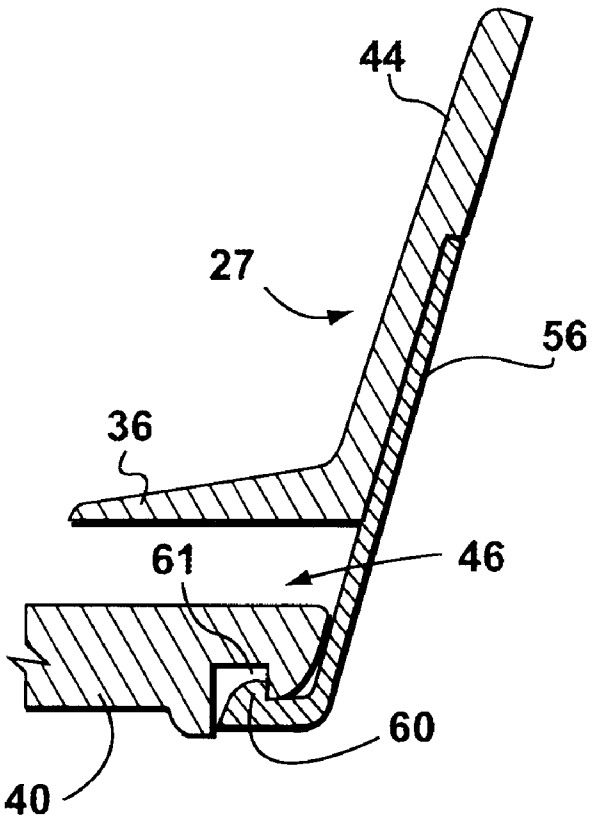
FIG. 8 is a further view of FIG. 7.
Figure 7:
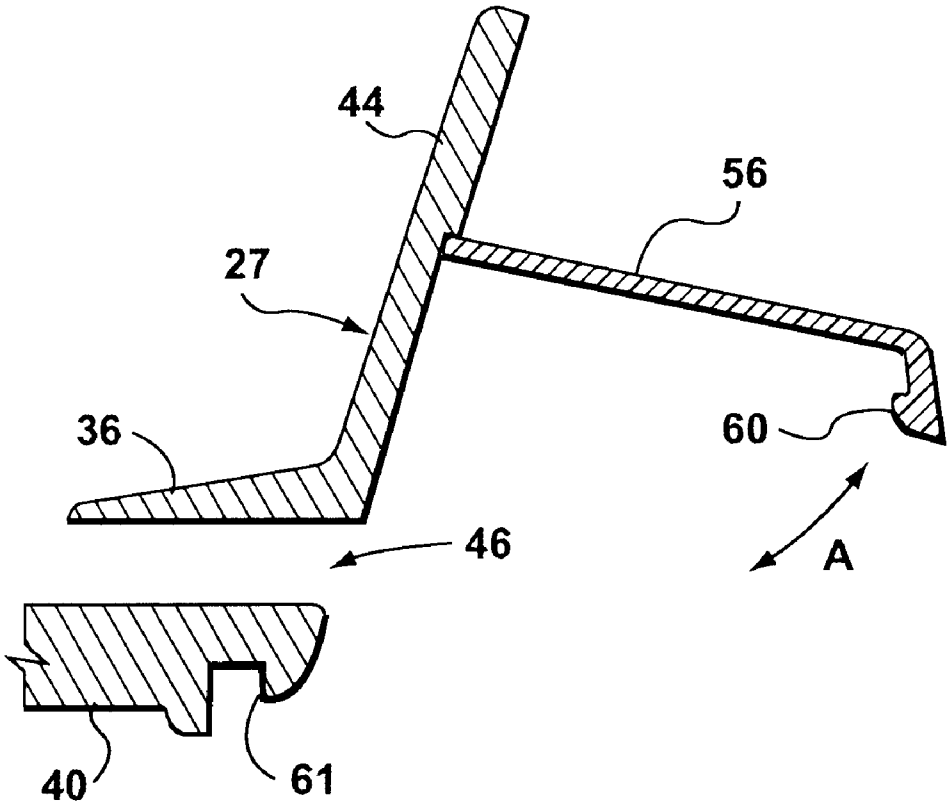
FIG. 7 is a cross sectional view taken along VII—VII of FIG. 1.

As illustrated in FIGS. 7 and 8, rear frame member 27 is comprised of a lower portion 40 and an upper portion having a rear lip 36 and a back 44 extending upwardly therefrom. Lower portion 40 has a flat top surface. The bottom of lower portion 40 has a lengthwise extending groove 61 proximate the rear edge of lower portion 40, which will be further described below. The width of lower portion 40 (the distance between the rear edge and the inner edge) approximates that of lip 36. Lower portion 40 and the upper portion 42 extend between side members 25*a* and 25*b* and are spaced to define a slot 46. Slot 46 has a height approximately equal to the thickness of sheet 22. Back 44 creates a rear bumper for shelf 20, which is eventually pushed into abutment with a rear cabinet or appliance wall (not shown). Back 44 may prevent scratching of the rear wall, acts as a stop, and prevents spillage onto the rear wall of the cabinet or appliance.

As best illustrated in FIG. 1, lip 30 of front frame member 23, lips 28*a* and 28*b* of side frame members 25*a* and 25*b*, and lip 36 of rear frame member 27 extend continuously along the entire periphery of sheet 22. Lips 28*a*, 28*b*, 30, and 36 extend from the outer edge of front, side, and rear frame members 23, 25*a*, 25*b*, and 27 towards the centre of the sheet 22. The width of the lips 28*a*, 28*b*, 30 and 36 is approximately five and one-half times the thickness of sheet 22. Lips 28*a*, 28*b*, 30, and 36 extend lengthwise substantially the entire length of the side members 25*a* and 25*b*, front member 23, and rear member 27, respectively. The top face of lips 28*a*, 28*b*, 30, and 36 slope downwards as these lips extend away from the edges of sheet 22 toward the centre of the sheet 22, thus inhibiting spill over the lips.

Figure 6:
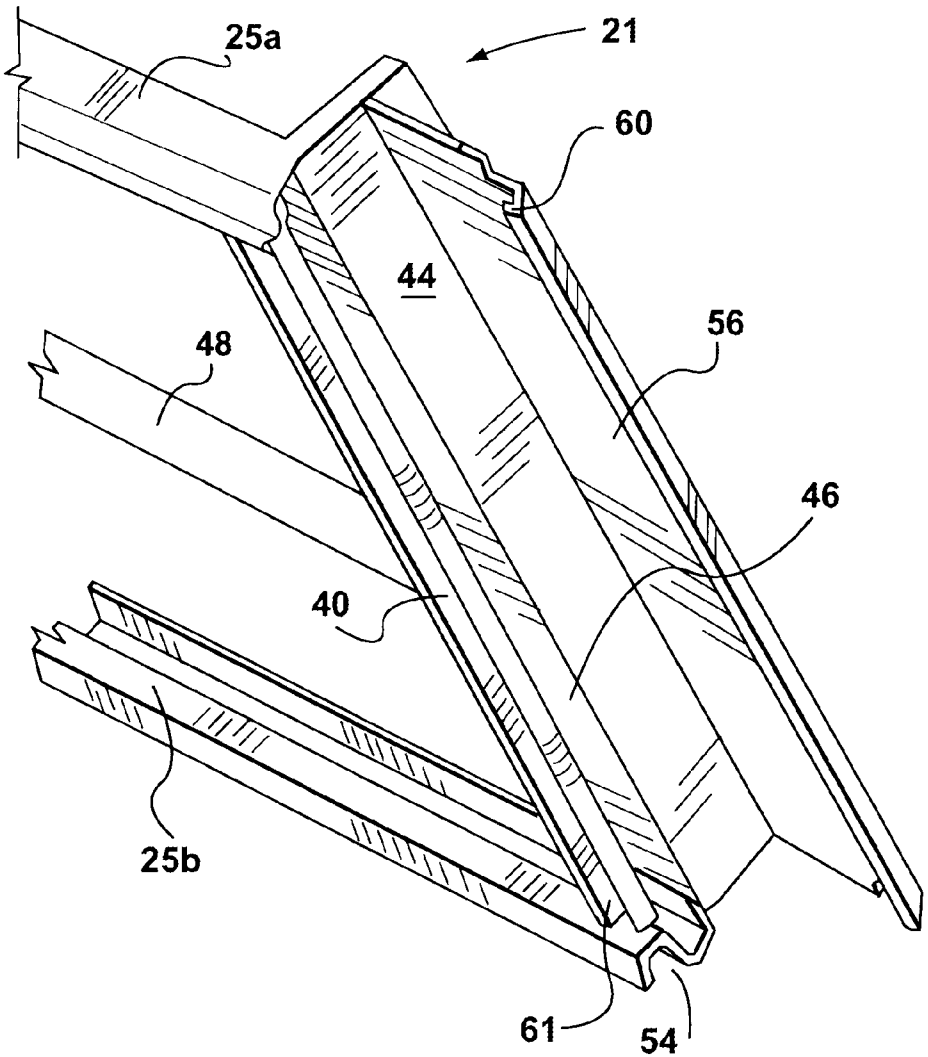
FIG. 6 is an enlarged perspective view of a portion of the shelf of FIG. 1.

Additionally, as illustrated in FIGS. 1, 2 and 6, a centre rail 48 extends at a right angle from approximately the mid-point of front member 23 to rear member 27. Rail 48 is in contact with bottom surface 19 of sheet 22, and provides support for a load placed on top surface 18. The width of rail 48 approximates the width of side members 25*a* and 25*b*.

As shown in FIGS. 6–8, a cover 56 is pivotally attached to the outside portion of the upwardly extending back 44 of rear frame member 27. Cover 56 extends along the entire length of rear member 27, to cover slot 46 in closed, forwardly pivoted position (FIG. 8). In a raised position, as best illustrated in FIGS. 6 and 7, cover 56 exposes slot 46 in rear member 27, for insertion and removal of sheet 22, as described below. Cover 56 may be pivoted in the direction "A" (FIG. 7) through an arc of approximately 110° to open and close cover 56. Cover 56 is integrally formed with back 44 of rear member 27. The pivotal movement of cover 56 is achieved by decreasing the thickness of the plastic at the juncture between the cover 56 and back 44 of rear member 27, allowing the material (typically plastic) at this juncture to be flexible, and thus forming a hinge. At its free end, away from back 44, cover 56 has a hooked edge 60 which extends along its entire length. The lower flat portion 40 of rear member 27 has a complementary groove 61 which extends the entire length of rear member 27, and engages hooked edge 60, when cover 56 is in its closed position (FIG. 8). Cover 56 is latched in place by snapping hooked edge 60 into corresponding groove 61.

Frame 21 is integrally formed of a heat sensitive injection-moulded material. The material is preferably plastic with a specific gravity of approximately 1.04. The plastic may be a copolymer polypropylene with an approximately ten percent talc additive and may be recycled.

Shelf 20 is manufactured by first plastic injection moulding frame 21. Frame 21 is formed using a single mould made of P20 tool steel and conventional injection moulding techniques. Molten plastic is forced under pressure into an injection mould having a cavity adapted to form the above described frame 21, at a temperature of approximately 370° F.–400° F. and a pressure of approximately 1600–1800 psi. The resin is then allowed to cool slightly ie. to approximately 120°, until frame 21 is sufficiently hard to withstand insertion into its grooves of a planar pre-cut sheet 22. The thickness of the grooves is greater than that of sheet 22. Frame 21 is then removed from the mould and placed onto a fixture. Sheet 22, having dimensions suitable for frame 21, is then slid into the frame 21 through slot 46 of rear member 27, into the grooves 50 of the side member 25*a* (and a corresponding groove in side member 25*b*), until the front edge of sheet 22 rests in abutment with wall 32 of front member 23. Cover 56 is then rotated as shown in FIG. 7 into its latched position with hooked edge 60 engaging slot 61 as shown in FIG. 8, closing the slot 46. Shelf 20 is then placed on a cooling aid. Frame 21, upon cooling, contracts such that the groove 50 in side frame member 25*a* and the corresponding groove in side frame member 25*b* shrink, causing the lips 28*a* and 28*b* to tightly abut the top surface 18 of sheet 22 around its periphery. Front frame member 23 contracts causing ledge 34 and lip 30 to tightly abut sheet 22. Rear frame member 27 similarly contracts, narrowing slot 46, pushing bottom portion 40 and lip 36 of rear frame member 27 into abutment with sheet 22. Contraction ceases after approximately forty-eight hours. This results in a substantially spill-resistant shelf 20. The heat sensitive material of which frame 21 is formed shrinks linearly in all directions by a factor of approximately 0.013 to 0.016 per inch, as frame 21 cools to room temperature.

In use, shelf 20 may be inserted in a cabinet or appliance (not shown). Tracks on the inner walls of the cabinet or appliance engage channels 54, to support shelf 20 so that the top surface 18 of sheet 22 may support food, medicine, drink, etc. Shelf 20 is slid into the cabinet or appliance with rear frame member 27 leading, until the back 44 abuts the back wall of the interior of the cabinet or appliance. Centre rail 48 may be used to slide shelf 20 in and out of the cabinet or appliance along the support tracks.

In the event that a small amount of liquid is spilled on top surface 18 of shelf 20, the liquid may spread toward front, side and rear edges of sheet 22. However, because of the outwardly upward slope of lips 28*a*, 28*b*, 30 and 36, small amounts of liquid are unlikely to spill over these lips. Additionally, as the entire frame 21 has contracted to tightly engage sheet 22, the juncture between lips 28*a*, 28*b*, 30 and 36 and the corresponding portions of top surface 18 should be virtually impermeable to liquids. The spilt liquid is thus trapped on top surface 19, by lips 28*a*, 28*b*, 30 and 36. As such, spilt liquid may easily be cleaned from the shelf 20.

If sheet 22 or frame 21 should break, the cover 56 may be snapped open thereby exposing slot 46. Shelf 20 may then be re-heated to approximately 120° F. to 140° F. using the radiant heat of light bulbs or a hot air appliance, thereby expanding frame 21 linearly about sheet 22 so that groove 50, the corresponding groove in side member 25*b*, and the gap between lip 30 and ledge 34 widen. This, in turn permits easy removal of sheet 22 from frame 21 through slot 46. The broken portion, sheet 21 or frame 22 as required, of shelf 20 may then be replaced and recycled. Depending on the working environment, frame 21 may need to be reheated several times in order to properly remove and replace sheet 21 or frame 22. This warming step does not cause frame 21 to lose its shape or ability to grip sheet 22, after replacement and cooling.

A person skilled in the art will recognize that numerous modifications to the above described embodiments are possible. For example, the material used to create the frame may be varied, provided it can expand upon heating and contract upon cooling, within an appropriate range of shrinkage. The dimensions and shape of sheet 22 may also be varied. Sheet 22 need not be rectangular, but may be oval or square. Cover 56 need not be pivotally attached to rear member 27, but may be created independently of the frame 21 and suitably attached. Lip 34 of front member 23 is not necessary. Also, the elements of the frame need not be integrally formed, as long and the formed frame expands and contracts to engage sheet 22. Centre rail 48 need not extend at a midpoint of front or rear member 23, 27; several or no support rails could be used. As well, back 44 could be eliminated.

A person skilled in the art will also appreciate that by eliminating channels 54, centre rail 48, and back 44 of the shelf described above, a table top in accordance with the invention may be created.

Numerous other modifications, variations, and adaptations may be made to the particular embodiments of the invention described above without departing from the spirit and scope of the invention, as defined by the claims.

We claim:

1. A spill-resistant article support comprising:

a generally planar sheet having a flat top surface;

a frame receiving said sheet, said frame comprising:

first and second opposing side members each defining a lengthwise extending grove;

said grooves receiving opposing edges of said planar sheet;

said first and second side members each comprising a side lip;

each said side lip partially covering said top surface;

a front member, extending between said side members and in abutment with an end of said sheet;

said front member comprising a front lip;

said front lip partially covering said top surface;

said side lips meeting said front lip such that said lips extend continuously along a periphery of said sheet;

said frame comprised of heat sensitive material;

said material adapted to expand at a first temperature so that said sheet is freely slidable within said grooves for easy removal of said sheet from said frame;

said material further adapted to contract at a second temperature so that said edges of said sheet are tightly engaged within said grooves and said side and front lips tightly abut said top surface to inhibit spillage of liquids from said top surface at said periphery.

2. The article support of claim 1, wherein said frame further comprises a rear member, said rear member extending between said side members;

said rear member defining a slot;

said slot permitting removal of said sheet from said frame at said first temperature.

3. The article support of claim 2, wherein said rear member further comprises a rear lip; said rear lip partially covering said top surface, said rear lip meeting said side lips such that said rear, side, and front lips extend continuously along the entire periphery of said sheet;

said rear lip tightly abutting said top surface at said second temperature.

4. The article support of claim 2, wherein said frame further comprises a movable cover; said cover adapted to cover said slot.

5. The article support of claim 4, wherein said cover is pivotally attached to said rear member;

and is pivotally moveable from a first position, whereat said cover covers said slot, to a second position, whereat said cover is raised away from said slot thereby permitting removal of said sheet from said frame through said slot at said first temperature.

6. The article support of claim 5, wherein said cover comprises a flap having a hooked edge.

7. The article support of claim 6 wherein said rear member comprises a groove, adapted to engage said hooked edge to latch said cover in said first position.

8. The article support of claim 2, wherein said frame further comprises a rail;

said rail extending from said front member to said rear member, along a bottom surface of said sheet.

9. The article support of claim 1, wherein each of said side members defines a lengthwise extending mounting channel, said channel permitting attachment of said frame to an interior of an appliance or cabinet.

10. The article support of claim 1, wherein said heat sensitive material is plastic.

11. The article suport of claim 10, wherein said heat sensitive material is comprised of a copolymer polypropylene and talc additive.

12. The article support of claim 11, wherein said talc additive comprises approximately 10% of said heat sensitive material.

13. The article support of claim 10, wherein said frame is injection-moulded.

14. The article support of claim 13, wherein said frame is integrally formed.

15. The article support of claim 11, wherein said frame contracts linearly between 0.01 to 0.020 inches in all directions between said second and said first temperatures.

16. The article support of claim 11, wherein said frame is injection moulded prior to insertion of said sheet into said frame.

17. The article support of claim 1, wherein said sheet comprises tempered glasses, polycarbonate or acrylic.

18. The article support of claim 1, wherein said frame is formed prior to insertion of said sheet into said frame.

19. The article support of claim 1, wherein each of said grooves extends to an opening extending from one of said side members, each of said openings distal from said front member, said openings permitting insertion and removal of said sheet into said grooves when said frame is at said first temperature.

20. A substantially rigid frame for a spill-resistant article support, said frame for receiving a generally planar sheet having a flat top surface, said frame comprising:

first and second opposing side members each defining a lengthwise extending groove;

said grooves for receiving opposing edges of said planar sheet;

said first and second side members each comprising a side lip;

each said side lip partially covering said top surface;

a front member, extending between said side members and in abutment with an end of said sheet;

said front member comprising a front lip;

said front lip partially covering said top surface;

said side lips meeting said front lip such that said side lips and said front lip extend continuously along a periphery of said sheet;

said frame comprised of heat sensitive material;

said material adapted to expand at a first temperature so that said sheet is freely slidable within said grooves for easy removal of said sheet from said frame;

said material further adapted to contract at a second temperature so that said edges of said sheet are tightly engaged within said grooves and said side and front lips tightly abut said top surface to inhibit spillage of liquids from said top surface at said periphery.

21. The frame of claim 20, wherein each of said grooves extends to an opening extending from one of said side members, each of said openings distal from said front member, said openings permitting insertion and removal of said sheet into said grooves when said frame is at said first temperature.

22. The frame of claim 20, formed within an injection mould, prior to insertion of a sheet into said frame.

* * * * *